United States Patent [19]

Gonzalez

[11] Patent Number: 4,656,944

[45] Date of Patent: Apr. 14, 1987

[54] SELECT FIRE WELL PERFORATOR SYSTEM AND METHOD OF OPERATION

[75] Inventor: Manuel E. Gonzalez, Corpus Christi, Tex.

[73] Assignee: Exxon Production Research Co., Houston, Tex.

[21] Appl. No.: 805,688

[22] Filed: Dec. 6, 1985

[51] Int. Cl.[4] ..... F42B 3/00

[52] U.S. Cl. ..... 102/312; 102/202; 102/209; 175/4.55; 181/116

[58] Field of Search ..... 102/202.5, 209, 312, 102/313, 472; 299/13; 175/4.55; 181/102, 103, 106, 107, 116

[56] References Cited

U.S. PATENT DOCUMENTS

| | | | |
|---|---|---|---|
| 1,757,288 | 5/1930 | Bleecker | 102/206 |
| 2,507,351 | 5/1950 | Scherbatskoy | 177/352 |
| 3,086,465 | 4/1963 | De Montfort | 102/206 X |
| 3,105,547 | 10/1963 | Ownby | 166/65 |
| 3,264,994 | 8/1966 | Leutwyler | 102/206 |
| 3,383,586 | 5/1968 | Hoehn, Jr. | 340/855 X |
| 3,601,196 | 8/1971 | Childers | 166/55.1 X |
| 3,773,120 | 11/1973 | Stroud et al. | 175/4.55 |
| 3,877,373 | 4/1975 | Bergmann et al. | 102/312 |
| 4,023,136 | 5/1977 | Lamensdorf et al. | 340/18 NC |
| 4,026,215 | 5/1977 | Ziemba et al. | 102/206 |
| 4,066,994 | 1/1978 | Patchett et al. | 175/4.55 X |
| 4,072,108 | 2/1978 | Lewis et al. | 102/209 |
| 4,206,707 | 6/1980 | Shores | 102/472 |
| 4,454,814 | 6/1984 | Henry et al. | 175/4.55 X |
| 4,478,294 | 10/1984 | Sumner | 175/4.56 |
| 4,597,067 | 6/1986 | Brockhorst et al. | 181/102 X |

*Primary Examiner*—Peter A. Nelson

*Attorney, Agent, or Firm*—John S. Schneider

[57] ABSTRACT

A well perforator system and method employs an electromagnetic wave frequency receiver, one for each of at least two gun intervals, that receives a transmitted signal conveyed through well tubing from the earth's surface. The signal is converted to an electrical pulse which detonates a blasting cap and fires the gun perforators. Each gun interval is a separate system with different activating frequencies and each is separately activated to assure that all the intervals are fired. A timer may be used to activate the electromagnetic wave receiver after the gun is in the well to prevent accidental surface firing of the guns from stray sources of electromagnetic waves. Once in the well, only the transmitted pulses are able to detonate the guns. Once the last interval is fired, a wave frequency-activated gun above the uppermost gun interval is detonated with circulation shots to penetrate only the tubing. This creates an instant, intense pressure drop across the perforations to help in cleanup. Once the pressure equalizes, a casing cutter can be lowered down the well to cut the guns off and have them dropped to bottom. A microphone may be positioned at the earth's surface to detect firing of the guns.

8 Claims, 8 Drawing Figures

16
14
25
50
47
50a
10
60
11
50b
47a
50c
12
60a
50d
47b
50e
60b
13

SELECT FIRE WELL PERFORATOR SYSTEM AND METHOD OF OPERATION

BACKGROUND OF THE INVENTION

The present invention concerns a multiple gun tubing-conveyed well perforator system in which the gun charges are fired selectively in response to electromagnetic wave frequencies transmitted from the earth's surface.

The present methods used in detonating tubing-conveyed well perforating systems have disadvantages in that the gun charges must be fired from the top down to the bottom of the gun as one continuous system. Furthermore, when several different intervals are involved, the probability of a misfire because of the interconnecting length between guns is increased, adding to the unreliability of the entire system. Another disadvantage of the present methods is the inability of the perforator systems to determine if all of the interval's gun charges actually fired.

Currently in the industry, tubing-conveyed perforator systems consist of either (1) mechanical devices dropped down the tubing to detonate the gun charges by pressing a plunger or (2) an electric line lowered down the tubing to provide electrical power to detonate the gun charges.

SUMMARY OF THE INVENTION

In the tubing-conveyed well perforator system of the present invention, an electromagnetic wave frequency receiver receives a transmitted electromagnetic wave frequency signal conveyed down the tubing from the earth's surface. There is one such receiver for each gun interval. The transmitted signal is converted to an electrical pulse which detonates the blasting cap. Each gun interval is a separate system with a different activating frequency. A timer may be used to activate the receiver only after the guns are in the well to prevent accidental surface firing of the guns from stray sources of electromagnetic waves. Once in the well, only the transmitted pulses can detonate the guns. Once the last interval is fired, a frequency-activated circulation gun interval located above the uppermost gun interval may be detonated with the shots penetrating only the tubing. An instant, intense pressure drop across the perforations is thereby created to help in cleanup. Once the pressure equalizes, a casing cutter may be lowered down the well to cut off the guns and permit them to drop to the bottom of the well.

DESCRIPTION OF THE PREFERRED EMBODIMENTS

Figure 1:
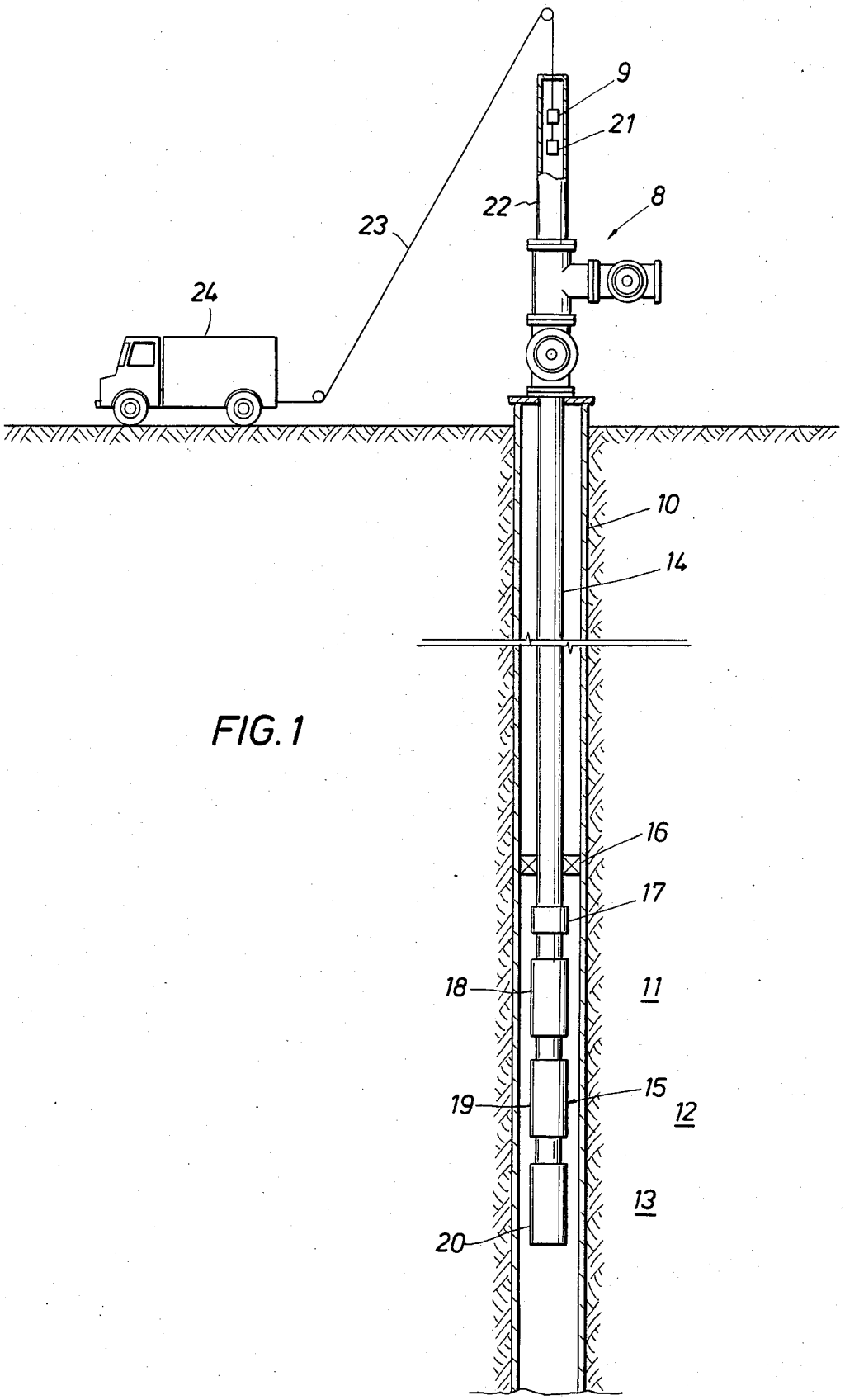
FIG. 1 is a schematic diagram illustrating a tubing-conveyed gun assembly fired by electromagnetic waves in accordance with the concepts of the present invention.

Referring to FIG. 1, there is shown a cased bore hole 10 penetrating three producing intervals or formations 11, 12, and 13. A tubing 14 extends through bore hole 10 from above the earth's surface to adjacent the producing formations. Suspended on the lower end of tubing 14 is a perforator gun assembly 15. A packer 16 closes off the annulus between tubing 14 and casing 10. Gun assembly 15 includes an upper circulation gun interval 17, an upper gun interval 18, a middle gun interval 19, and a lower gun interval 20. An electromagnetic signal generator 21 is located at the earth's surface to transmit electromagnetic wave signals, preferably in the microwave range, of different frequencies down dry tubing 14 to actuate each gun interval separately. Signal generator 21 may be suspended in a lubricator 22 on an electric cable 23 that is connected to an electric line truck or other electric power source 24. Lubricator 22 is attached to a wellhead 8 which is, in turn, connected to the upper end of tubing 14. A microphone 9 may also be suspended in lubricator 22 on cable 23.

Figure 2:
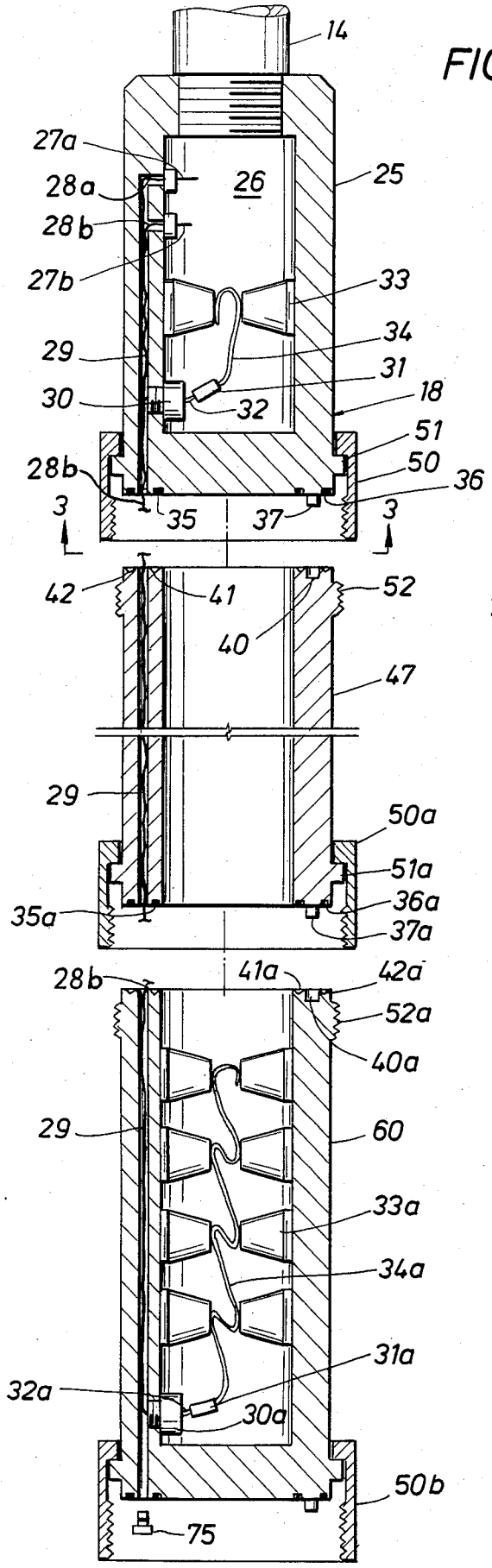
FIG. 2 is a sectional view of a portion of the gun assembly shown in FIG. 1.
Figure 3:
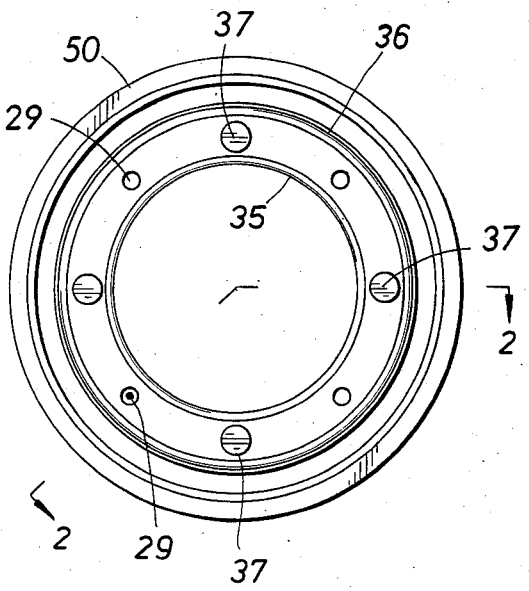
FIG. 3 is a view taken on lines 3—3 of FIG. 2.

As seen in FIGS. 2 and 3, the lower end of tubing 14 is threaded into the upper end of a housing 25 of circulation gun interval 17. The hollow interior 26 of housing 25 contains two antennae 27*a* and 27*b*. An antenna wire 28*a* extends from antenna 27*a* through one of the conduits 29 formed in the wall of housing 25 to an electromagnetic receiver 30 in housing 25. Receiver 30 is connected to a blasting cap 31 by a wire 32 and blasting cap 31 is connected to the circulation guns 33 by detonation cord 34.

The bottom of housing 25 contains inner and outer concentric ring seal grooves 35 and 36 on each side of conduits 29 and guide posts 37. Guide posts 37 engage guide post recesses 40 formed on the upper end of spacer housing 47 used to space out the gun intervals. On each side of conduits 29 and recesses 40 formed in the wall of housing 47, are inner and outer concentric grooves 41 and 42 for sealingly engaging metal ring seals with grooves 35 and 36. A threaded collar 50 supported on a flange 51 formed on housing 25 threads onto threads 52 on spacer housing 47 to lock spacer housing 47 sealingly to housing 25.

A threaded collar 50*a* supported on a flange 51*a* on the lower end of spacer housing 47 threadedly engages threads 52*a* on the upper end of gun perforator housing 60 of gun interval 18. In a manner similar to that described for connecting housing 25 to spacer housing 47, the lower end of spacer housing 47 is connected to the upper end of gun housing 60; metal ring seals engage grooves 35*a*–36*a* and 41*a*–42*a*, and guide posts 37*a* engage guide post recesses 40*a*. A receiver 30*a* in gun perforator housing 60 is connected to a blasting cap 31*a* by wire 32*a*. Blasting cap 31*a* is, in turn, connected to each of the guns 33*a* by detonation cord 34*a*. Wire 28*b* extends from antenna 27*b* through another of the conduits 29 formed in the wall of housing 60 to receiver 30*a*. Similarly, the receivers associated with gun intervals 19 and 20 receive different frequency signals from other antennae by means of wires extending through other conduits. Each of the antennae 27*a*, 27*b*, etc. is cut to the frequency of the receiver 30, 30*a*, etc. to which that antenna is connected.

Plugs 75 may be used to close off the bottom of conduits 29 on the lowermost gun assembly housing.

Figures 4, 5, 6:
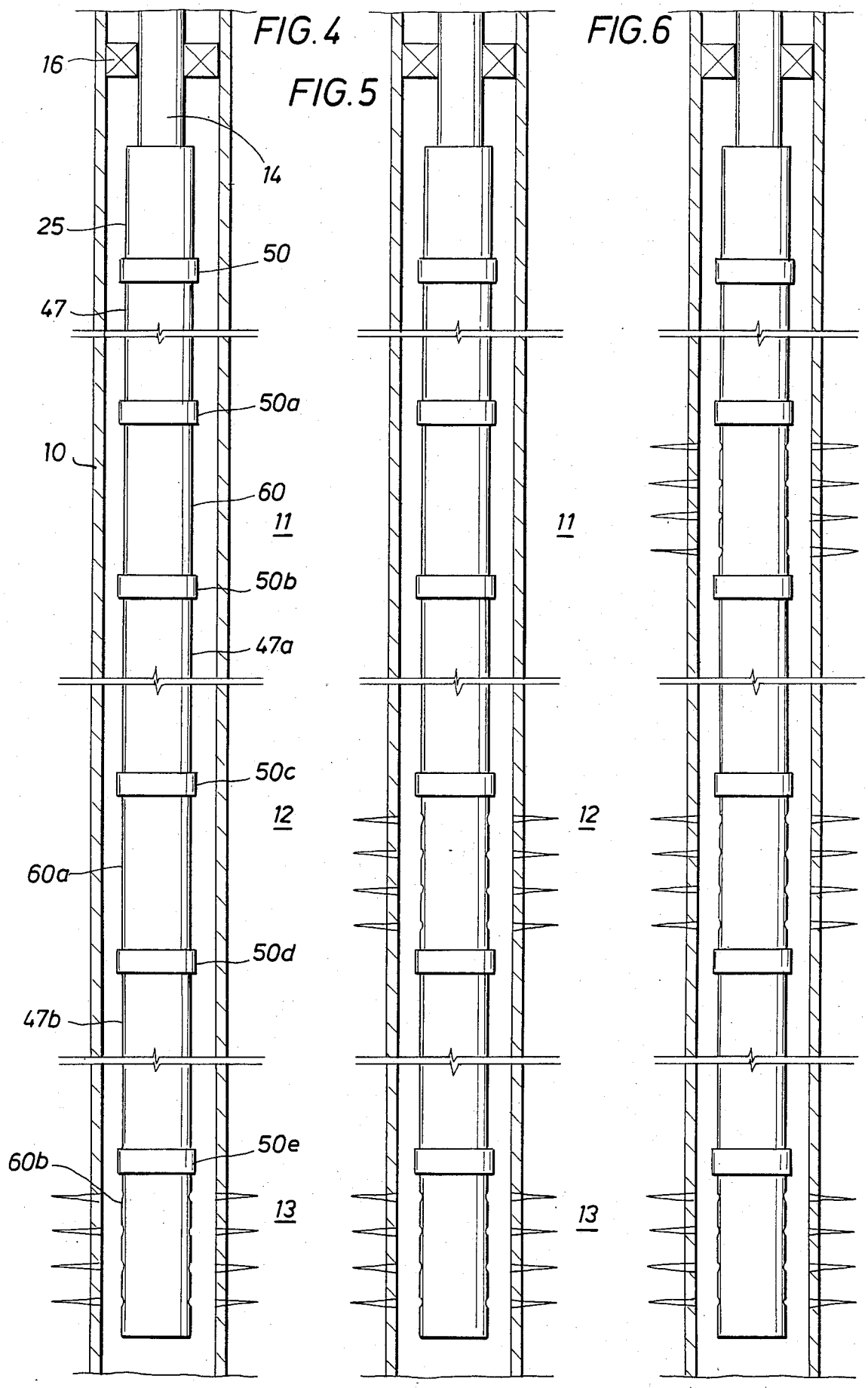
FIGS. 4, 5, and 6 are side views of the gun assembly shown in FIG. 1 illustrating the sequence of firing of three producing intervals.

In FIGS. 4, 5 and 6, the perforator system contains the circulation gun housing 25, the upper gun housing 60, a middle gun housing 60*a*, and a lower gun housing 60*b*. Spacer housing 47 is connected to circulation gun housing 25 and upper gun housing 60 by collars 50 and 50*a*; a spacer housing 47*a* is connected to upper gun housing 60 and middle gun housing 60*a* by collars 50*b* and 50*c* and a spacer housing 47*b* is connected to middle gun housing 60*a* and lower gun housing 60*b* by collars 50*d* and 50*e*.

In operation, the electromagnetic signal generator 21 transmits a signal of predetermined frequency down tubing 14. The signal is picked up by one of the antennae 27 and transmitted by a wire 28 in one of the conduits 29 to lower gun housing 60*b* where the signal is received in the receiver and transmitted to the blasting cap causing the detonation cord to fire the guns to perforate interval 13. Firing of those charges is illustrated in FIG. 4. The microphone 9 at the surface may be used to indicate firing of those charges.

Next, a different wave frequency is transmitted by the electromagnetic signal generator 21 down tubing 14 and is picked up by another of the antennae 27 and transmitted to the receiver in the middle gun housing 60*a* and the charges that housing are fired to perforate interval 12 as illustrated in FIG. 5.

Similarly, a third different frequency is transmitted by the electromagnetic signal generator 21 down tubing 14 to fire the guns in upper gun housing 60 to perforate interval 11 as illustrated in FIG. 6. As seen also in FIG. 2 the third frequency signal is picked up by antenna 27*b* and transmitted on wire 28*b* is one of the conduits 29 to receiver 30*a* which converts the signal on an electrical signal that is transmitted over wire 32*a* to detonate blasting cap 31*a* and detonation cord 34*a* to fire guns 33*a*.

In that manner, all three intervals are perforated or, if for some reasons the guns don't fire, microphone 9 will indicate that failure to perforate.

Figure 7:
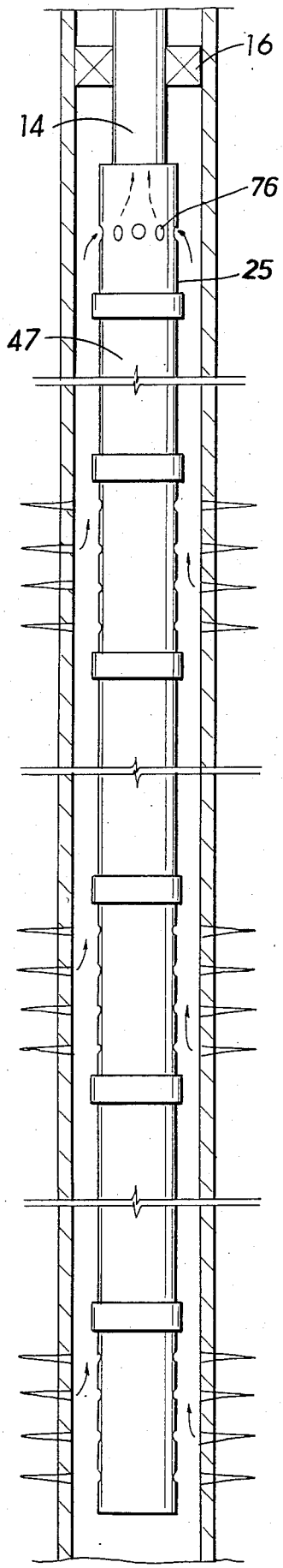
FIG. 7 is a side view of the gun assembly shown in FIG. 1 illustrating perforation of the circulation gun interval.

As illustrated in FIG. 7, after the three intervals have been perforated, a different fourth frequency is transmitted by electromagnetic signal generator 21 down tubing 14 and is picked up by antenna 27*a* in circulation gun housing 25. That signal is transmitted through wire 28*a* in a conduit 29 to receiver 30 and an electric signal is transmitted through wire 32 to blasting cap 31 to fire the circulation charges 33. These charges are sufficient to perforate the wall of housing 25 but not casing 10. Seals on packer 16 close off the annulus between tubing 14 and casing 10. As indicated by the arrowed lines in FIG. 7, once the circulation charges have been fired, production fluids flow from the three intervals 11, 12 and 13 through perforations 76 and up tubing 14 to the surface to effect perforation cleanup and initiate production.

Figure 8:
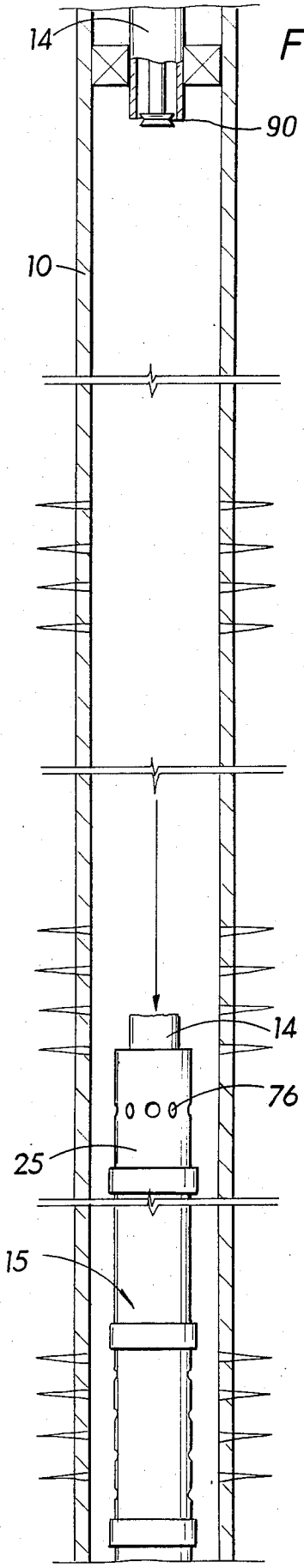
FIG. 8 is another side view showing the gun assembly severed from the tubing.

As shown in FIG. 8, a casing cutter 90 may be lowered through tubing 14 to sever the perforator system 15 from tubing 14 and permit the perforator assembly 15 to drop to the bottom of the well.

The gun blast from each gun interval will normally be heard and felt at the surface. However, to ensure detection of the gun blasts, microphone 9 located with transmitter 21, preferably in the lubricator, may be used to detect the noise caused by the firing of each independent gun interval, thereby determining if all intervals have fired. In present perforator systems connected in series, if any one of the firing intervals fails, all other firing intervals below it will also fail. There is also no way of knowing that a problem occurred since the firing of the upper intervals will mask any misfires. Since the perforator described herein fires each interval individually, and all are independent of each other, one interval misfiring does not affect any other. Separately activating each gun interval assures the operator that all of the gun intervals have fired. Or the operator will know which gun interval did not fire so that it can be perforated at a later time. With the present systems, the operator will be unaware that a problem exists and might flow only one stringer of a reservoir, thinking that the entire reservoir has been depleted.

Microwaves are only one of many types of electromagnetic waves that may be used to activate the guns. Although electromagnetic waves are propogated in straight lines, they will be reflected by the walls of the dry tubing 14 until they are picked up by the antennae 27.

While the perforating guns are not shown in detail, they may typically comprise high density perforating guns containing multiple-shaped charges stacked one above the other. The electromagnetic wave receiver equipment is standard radio receiver circuit equipment shielded to withstand the temperatures downhole. Such receivers will not be subjected to any downhole pressure until the interval has been fired.

This invention combines the advantages of the surging tools currently available in the market with a means of reliably perforating formations using casing guns that are more powerful than standard wireline guns. Employing standard prior art methods, the first perforation takes advantage of the full pressure differential in the well. However, each subsequent perforation, although done in fractions of a second, will have less efficiency to aid in cleanup due to the invasion of the pressure wave following the previous shots. In the present invention, all of the perforations will surge at the same time, thereby cleaning all perforations with the same efficiency and it will do so with a large pressure drop.

Various modifications of the invention set forth above may be made without departing from the scope of the invention as defined in the appended claims.

I claim:

1. A method for firing sequentially at least two vertically spaced-apart perforator guns connected to the lower end of tubing suspended in a well to perforate subsurface intervals surrounding said well comprising the steps of:

transmitting from the earth's surface electromagnetic waves having selected frequencies down said tubing to detonate the charges of one of said perforator guns in response to said selected frequencies; and transmitting second electromagnetic waves having second different selected frequencies down said tubing to detonate the charges of a second of said perforator guns in response to said second selected frequencies.

2. A method as recited in claim 1 in which a casing surrounds said tubing and a packer closes off fluid flow in the annulus between said casing and tubing and a circulation gun perforator positioned above said other perforator guns and capable, when fired, of communicating the interior of said tubing and the perforated subsurface intervals and including the steps of:

transmitting from the earth's surface electromagnetic waves having third different selected frequencies down said tubing to detonate said circulation gun perforator in response to said third selected frequency.

3. A method as recited in claim 2 including picking up sound waves at the earth's surface in response to firing of said perforator guns.

4. A method as recited in claim 3 in which three vertically spaced-apart perforator gun perforate three vertically spaced-apart subsurface intervals.

5. A method as recited in claim 4 in which said electromagnetic waves comprise microwaves.

6. Apparatus for perforating subsurface intervals surrounding a cased well bore comprising:

an interval perforating device connectable to a tubing suspendable in a well;

said device comprising:

a first gun perforator, first detonation means connected to said first gun perforator for firing said first gun perforator upon detonation of said first detonation means, first electromagnetic receiver means connected to said first detonating means for detonating said first detonation means in response to a first electromagnetic wave having a first selected frequency; and a second gun perforator, a second detonation means connected to said second gun perforator for firing said second gun perforator upon detonation of said second detonation means, a second electromagnetic wave receiver means connected to said second detonation means for detonating said second detonation means in response to a second electromagnetic wave having a second selected frequency.

7. A perforator system for perforating spaced-apart subsurface intervals surrounding a cased well bore comprising:

a tubing suspended in said casing from the earth's surface;

a gun perforator assembly connected to the lower end of said tubing, said assembly comprising:

a circulation gun perforator for fluidly communicating the interior of said tubing and said perforated intervals and at least two vertically spaced-apart interval gun perforators for perforating said intervals, each gun perforator comprising gun perforator charges, means to detonate said charges, and receiver means responsive to selected electromagnetic wave frequencies for detonating said detonator means;

antennae means for receiving said selected electromagnetic wave frequencies;

means for transmitting said electronmagnetic waves to said receiver means; and electromagnetic wave generator means at the earth's surface for transmitting said selected electromagnetic waves down said tubing to said antennae.

8. A perforator system as recited in claim 8 including a microphone at the earth's surface to detect the sounds of said perforator guns when they are fired.

* * * * *